US006209977B1

(12) United States Patent
Vondrejs

(10) Patent No.: US 6,209,977 B1
(45) Date of Patent: Apr. 3, 2001

(54) MOBILE WORK STATION

(75) Inventor: Frank Vondrejs, Mississauga (CA)

(73) Assignee: Global Contract Limited Partnership, an Ontario Limited Partnership, Downsview (CA)

( * ) Notice: Subject to any disclaimer, the term of this patent is extended or adjusted under 35 U.S.C. 154(b) by 0 days.

(21) Appl. No.: 09/392,740

(22) Filed: Sep. 9, 1999

(30) Foreign Application Priority Data

Jun. 4, 1999 (CA) ..... 2274028

(51) Int. Cl.[7] ..... A47B 88/22
(52) U.S. Cl. ..... 312/294; 312/249.9; 312/314
(58) Field of Search ..... 312/281, 249.9, 312/290, 309, 314, 317.1, 317.3

(56) References Cited

U.S. PATENT DOCUMENTS 542,341 * 7/1895 Little ..... 312/249.9 X
2,803,514 * 8/1957 Calderon ..... 312/290 X
3,244,465 4/1966 Ulrich, Jr. et al. .
3,395,959 8/1968 White .
4,318,575 3/1982 Redlich .
4,368,935 1/1983 White .
4,491,375 1/1985 Ugalde .
4,893,885 1/1990 Borello .
5,401,095 * 3/1995 Williams et al. ..... 312/314 X
5,454,637 * 10/1995 Williams et al. ..... 312/249.9
5,507,570 * 4/1996 Williams et al. ..... 312/314 X

* cited by examiner

*Primary Examiner*—Peter M. Cuomo
*Assistant Examiner*—Michael J. Fisher
(74) *Attorney, Agent, or Firm*—Philip C. Mendes da Costa; Breskin & Parr

(57) ABSTRACT

A mobile work station has a generally compact configuration in the closed position. When opened, it has a lower drawer for access to stored material and may function as a filing cabinet and an upper work surface which may be used in a similar manner to the top surface of a desk.

27 Claims, 1 Drawing Sheet

MOBILE WORK STATION

FIELD OF THE INVENTION

This invention relates to furniture. In particular, this invention relates to mobile furniture for an office or the like.

BACKGROUND OF THE INVENTION

Various traditional designs for work places have been developed. Traditionally, workers were positioned in offices and were provided with desks, filing cabinets and the like. Each piece of furniture was relatively heavy and in many cases two people were required to move each piece of furniture. Each worker may be provided with an individual office which may be constructed using traditional construction methods (e.g. drywall and the like). Alternately, dividers had been used to create a number of individual offices in an open area.

More recently, office systems have been created which comprise, in combination, divider panels and support surfaces which may be hung on the panels to create a work station. While these office systems may be re-configured by a single worker, they are not intended to be reconfigured on a daily basis.

In order to deal with the addition of computers to the work place, additional pieces of furniture have been added to traditional furniture lines. Accordingly, in some cases, separate computer tables have been designed (see for example U.S. Pat. No. 4,491,375). Such pieces of furniture are intended for use with other pieces of furniture, such as desks, filing cabinets and the like so as to create a complete office environment.

Accordingly, one disadvantage of such designs is that they do not provide a mobile work station for a worker.

SUMMARY OF THE INVENTION

The instant invention provides a mobile work stationfor a single worker. It may be used in an office environment as well as in a home office environment. In design, the unit may replace a desk, a computer table and a filing cabinet in a single unit, all of which is mounted on wheels for ease of use.

In particular, in accordance with the instant invention there is provided an article comprising a main body portion defining a foot print for the article; a lower drawer having a front end and a rear end and slidably mounted with respect to the main body portion along a first line travel between a closed position and an open position, the front end of the lower drawer having at least one wheel associated therewith; and, an upper member slidably mounted with respect to the main body portion between an open position in which at least a portion of the upper member is horizontally displaced from the main body portion and a closed position in which the upper member is positioned within the foot print.

Accordingly, using the work station of the instant invention, people may easily be able to work together without significant difficulty. For example, if a number of people need to work together on a single project, they may each have a mobile work station that may house a computer and which may be wheeled to a common location. The people will then be able to work together for the desired purpose. Each person may have in their work station any current files which are required for the project (which may be stored in the lower drawer) and any tools which they may require for their project which may be stored in the upper drawer (anything from pens, pencils to drafting equipment and the like).

A further advantage of the instant invention is that by slidably mounting the top work surface to the work station, the work surface provides a convenient surface for a computer, especially a lap top computer. When the work surface is in the open position, an open area is preferably provided there below so that the user may bring their chair towards and preferably slightly under the work station so as to more ergonomically position themselves with respect to the keyboard.

In addition, by slidably mounting the work station in a different line of travel in which the lower drawer opens, the worker may have access to their files, as well as the contents of the upper drawer, while they are working on their computer. At the end of the day, the work station may easily be closed and rolled to a storage position if desired.

In one embodiment, the main body portion has a front end and a rear end, the front end of the main body portion having an opening to receive the lower drawer and the rear end of the main body portion having wheels associated therewith.

In another embodiment, the lower drawer has an upper perimeter defining open top and the article further comprises at least one slide having a first portion connected to the main body portion and a second portion connected to the lower drawer whereby the slide supports the upper perimeter in a horizontal plane when the lower drawer is open.

In another embodiment, the main body portion further comprises a compartment positioned beneath the upper member when the upper member is in the closed position, whereby the compartment defines an upper drawer which is open when the upper member is in the open position.

In another embodiment, the upper member has an upper surface which is flat to provide a work surface.

In another embodiment, the upper member slides at an angle which is preferably 90° to the first line of travel.

In accordance with the instant invention, there is also provided an article comprising: a main body portion; a lower drawer having a front end and a rear end and slidably mounted with respect to the main body portion along a first line travel between a closed position in which the lower drawer is received in the main body portion and an open position, the front end of the lower drawer having at least one wheel associated therewith; and, a member extendable outwardly with respect to the main body portion to an open position in which the member provides a generally horizontally disposed work surface which is displaced outwardly from the main body portion, the member moving outwardly in a second line of travel different to the first line of travel whereby the member has an open area there below when in the open position.

In accordance with the instant invention, there is also provided an article comprising: support means for receiving a lower drawer, the support means having a front and a rear, the rear having wheel means associated therewith; a lower drawer receivable in the support means and having a front portion and a rear portion, the front portion having wheel means for supporting the front portion of the lower drawer as the lower drawer moves outwardly from the support means in a first line of travel, the rear portion operatively connected to the support means for supporting the rear portion of the lower drawer as the lower drawer moves outwardly from the support means; and, a member having a flat surface moveable outwardly from the support means to provide a work surface having an open area there below.

In one embodiment, the support means further comprises a compartment positioned within the support means, whereby the compartment defines an upper drawer which is open when the member is moved outwardly from the support means.

In another embodiment, the member is slidably mounted on the support means.

In another embodiment, the compartment is positioned beneath the upper member when the upper member is in a closed position.

In another embodiment, the member moves outwardly at an angle of 90° to the to the first line of travel.

In accordance with another embodiment of the instant invention, there is provided an article comprising an upper drawer having side, front and rear panels; a lower drawer having side, front and rear panels; an exterior body defined by a plurality of the panels of the upper and lower drawers, the lower drawer movably mounted with respect to the upper drawer in a first line of travel and accessible from above when opened, the upper drawer openable in a second line of travel at an angle to the first line of travel; a plurality of legs provided adjacent the front panel of the lower drawer; a plurality of legs provided adjacent the rear panel of the upper drawer; and, at least one wheel associated with a forward portion of the lower drawer.

Another advantage of the instant invention is that panels which are used to construct the drawers are used to also form the outer shell of the work station. Thus the work station comprises two drawers and with legs attached thereto. The elimination of an outer shell to cover the drawers simplifies the manufacture of the unit and substantially reduces the weight of the unit.

DESCRIPTION OF THE DRAWINGS

These and other advantages of the instant invention will be more fully and completely understood in accordance with the following description of a preferred embodiment of the invention in which.

DESCRIPTION OF THE PREFERRED EMBODIMENT

Figure 1:
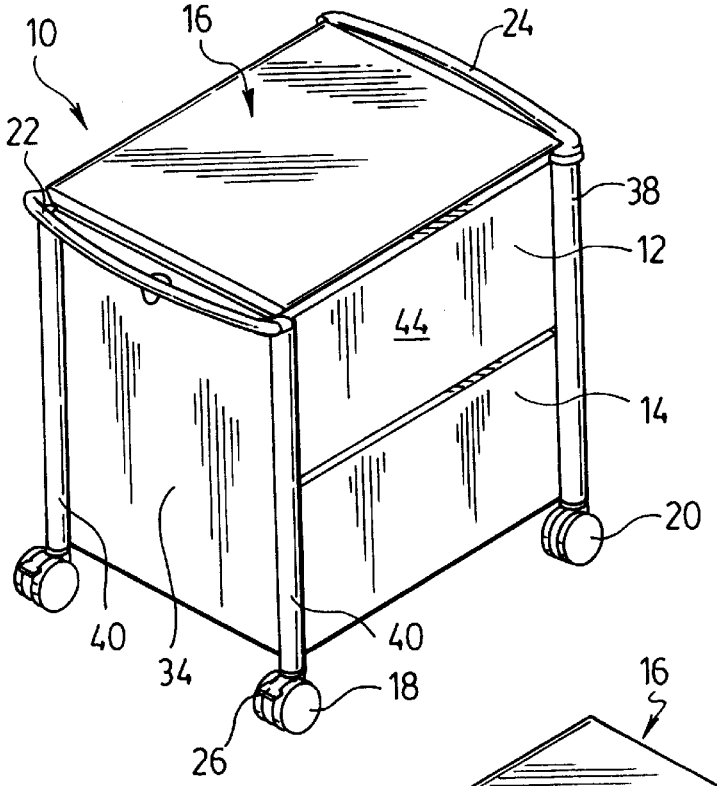
FIG. 1 is a perspective view from the side and above of a mobile work station according to the instant invention in the closed position; and, FIG. 2 is a perspective view from above and to one side of the mobile work station of FIG. 1 wherein the work station is in the fully open position.

Mobile work station 10 has a main body portion 12, a lower drawer 14, an upper member 16, front wheels 18 and rear wheels 20. Work station 10 may optionally include a front handle 22 and/or a rear handle 24 and, preferably, both a front handle 22 and a rear handle 24.

Wheels 18 and 20 may be of any particular design known in the furniture art and are preferably swivel mounted. By means of one or both of handles 22 and 24, work station 10 may be easily moved in any particular direction, particular if wheels 18, 20 are swivel mounted to work station 10.

Figure 2:
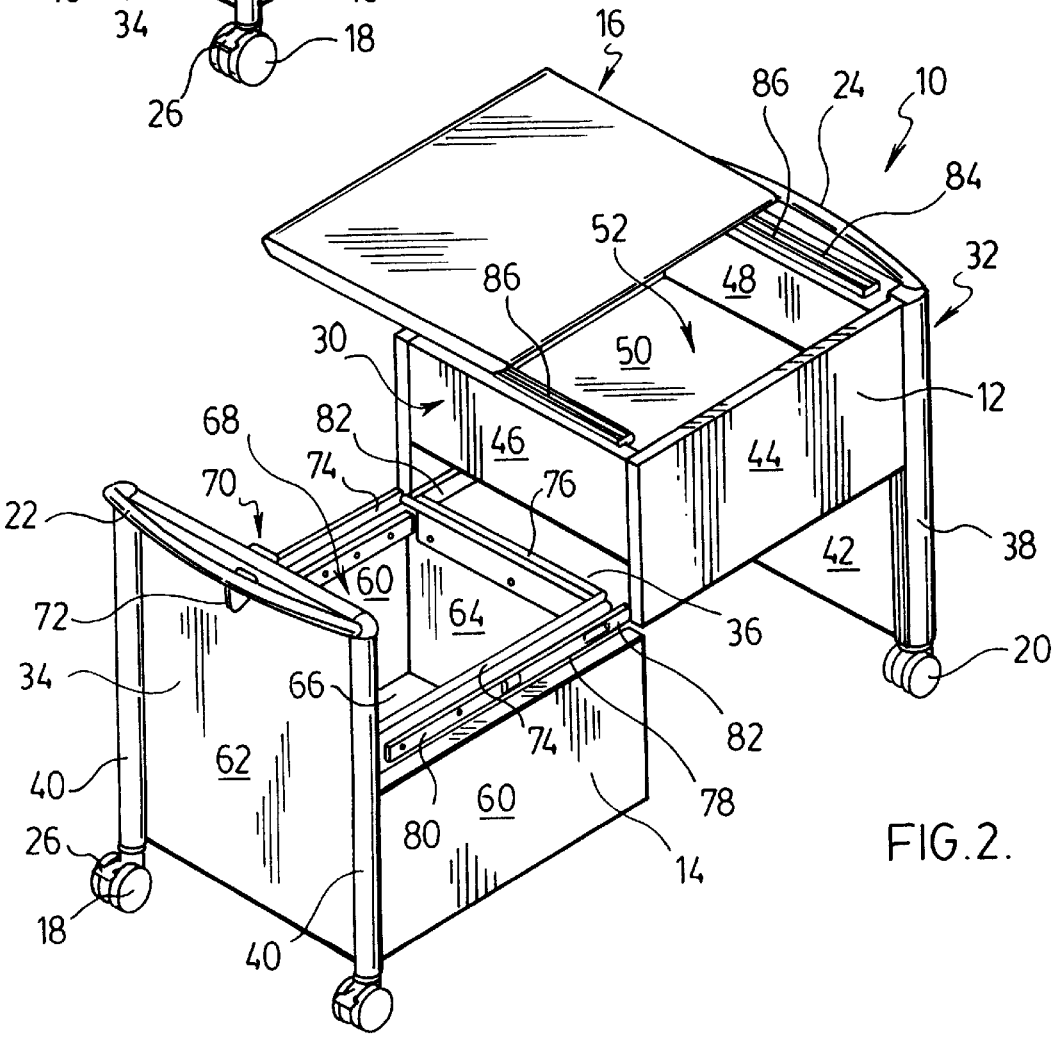

It will further be appreciated that one or more of wheels 18 and 20 may include a locking means to prevent work station 10 from moving when in a desired position. Any locking means known in the art may be used. For example, wheels 18 and 20 may include a lever 26 which, when depressed, will prevent the wheels from rotating. It will be appreciated that, as shown in FIGS. 1 and 2, only two of the wheels, such as front wheels 18, may be provided with such locking means.

In an alternate embodiment, it will be appreciated that work station 10 may be provided only with front wheels 18 or only rear wheels 20. In such an embodiment, work station 10 may still be easily moved by a user lifting the end which is not provided with wheels by means of the respective handle and then using wheels to move work station 10 to a desired location.

Main body portion 12 has a front end 30 and a rear end 32. Similarly, lower drawer 14 has a front end 34 and a rear end 36. Rear end 32 of main body portion 12 is provided with rear legs 38. Front end 34 of lower drawer 14 is provided with front legs 40. In the illustrated embodiment, work station 10 has four wheels. Accordingly, rear wheels 20 are positioned at the bottom of rear legs 38 and front wheels 18 are provided at the bottom of front legs 40.

In order to fully enclose work station 10, rear end 32 may comprise a vertically extending member 42 which may be positioned between rear legs 38 or may be positioned, for example, to enclose rear legs 38. The actual shape and configuration of vertically extending member 42 may be altered depending upon the aesthetics required for work station 10.

Main body portion 12 has a pair of longitudinal side panels 44 which extend between front panel 46 and rear panel 48. Main body portion 12 also includes the bottom panel 50 which, together with the front, rear and side panels defines a compartment 52 which may function as an upper drawer having a lid (upper member 16) for work station 10. It will be appreciated that the size and configuration of these panels may vary to provide the desired aesthetics and size of compartment 52. For example, side panels 44 may extend downwardly so as to surround the sides of lower drawer 14. Further, front panel 46 may be configured aesthetically so as to provide a completed exterior surface if lower drawer 14 does not cover front panel 46 when in the closed position of FIG. 1.

Referring to FIG. 2, lower drawer 14 comprises a pair of side panels 60 extending longitudinally between front panel 62 and rear panel 64. Lower drawer 14 also is provided with a bottom panel 66 which, together with the front, rear and side panels 60, 62 and 64 define compartment 68.

As shown in FIG. 2, front panel 62 may extend upwardly above lower drawer 14 so as to provide a front face for main body portion 12. Side panels 60 have a top surface 74 and rear panel 64 has a top surface 76. Top surfaces 74 and 76 define an upper perimeter which defines the top of lower drawer 14. Optionally, as shown in FIG. 2, front panel 62 may be provided with a lock 70 which may be actuated, for example by a removable key 72.

Lower drawer 14 is slidably mounted with respect to main body portion 12 along a first line of travel between the closed position shown in FIG. 1 and an open position. In FIG. 2, lower drawer 14 is shown in the fully open position. As wheels 18 are associated with the forward portion of lower drawer 14 (and preferably front end 34 thereof) the forward portion of lower drawer 14 is stabilized by wheels 18 and suspended above the ground as it slides into and out of main body portion 12. Any particular slide means known in the art may be used. Preferably, work station 10 has at least one such slide means (e.g. it may have a centrally mounted slide means). More preferably, work station 10 includes two slides 78 one of which is provided adjacent each side of lower drawer 14. Referring to FIG. 2, slide 78 may have a first portion 80 which may be affixed to the outer surface of side panel 60 and a second portion 82 which may be affixed to the inner surface of side panel 44. Accordingly, slides 78 supportively connect lower drawer 14 to main body portion 12 and, in particular, support the rear portion of lower drawer 14 above the ground when lower drawer 14 is in an opened position. In particular, the upper perimeter of lower drawer 14 may be maintained in a horizontal plane when the lower drawer is opened. It will be appreciated that lower drawer 14 may be configured to receive any particular material. Preferably, it is adapted to receive vertically hanging files using any hanging means known in the art.

Upper member 16 is extendable outwardly with respect to main body portion 12 to an open position in which upper member 16 provides a work surface. Preferably, upper member 16 is designed to be generally horizontally disposed when in the open position so as to provide a flat work surface, such as for a lap top computer. However, it will be appreciated that for certain applications, such as drafting, surface 16 may be at an inclined angle.

Upper member 16 may be extended outwardly by any means known in the art, such as by sliding, swinging or the like. Preferably, as shown in FIG. 2, upper member 16 is slidably mounted with respect to main body portion 12 and, more preferably, is slidably mounted above main body portion 12.

In the preferred embodiment of FIG. 2, the upper portion of compartment 52 is provided with a pair of slides 84 provided on opposed sides of compartment 52. Slides 84 comprise a first portion 86 which is secured to panels 46, 48 and a second portion which is secured to the lower surface of upper member 16 (not shown). Slides 84 supportively connect upper portion 16 to main body portion 12 so that, when upper member 16 is in an open position as shown in FIG. 2, it will be capable of supporting a load which is placed on the top thereof (e.g. a lap top computer). In FIG. 1, upper member 16 is shown in the closed position. When in the closed position, upper member 16 is within the footprint described by wheels 18 and 20. It will be appreciated that the exact size of upper member 16 need not be identical to the footprint described by wheels 18 and 20 but may be slightly larger or slightly smaller and still be within the scope of this invention.

It will be appreciated that upper member 16 need not form the top of main body portion 12 but may be slidably received in a compartment provided therein (not shown). However, preferably, upper member 16 is positioned immediately above compartment 52 so as to provide a lid thereof. Accordingly, when upper member 16 is moved to an open position, a person has access to upper compartment 52 via the top thereof. If upper member 16 does not provide an opening to compartment 52, it will be appreciated that no upper drawer may be provided in work station 10 or, alternately, the upper drawer may be accessed by any means known in the art such as by having a door that slides open or by having a pivotable panel to provide access thereto.

As upper member 16 extends outwardly from the footprint of main body portion 12 when in the open position, upper member 16 effectively comprises a cantilevered member which has an open area there below. Accordingly, if a person places a computer keyboard on top of upper member 16, they may pull their chair up to upper member 16 such that at least a portion of their legs are positioned underneath upper member 16 thereby providing improved ergonomics for the use of upper member 16 as a keyboard stand. It will be appreciated that upper member 16 may be extended outwardly from the front end, the rear end or either of the sides of main body portion 12. If upper member 16 extends outwardly from either side or the rear end of main body portion 12, then lower drawer 14 may be open and easily accessible while upper member 16 is extended outwardly from main body portion 12. More preferably, upper member 16 extends outwardly from one of side panels 44 of upper body portion 12 so that its line of travel is 90° to that of lower drawer 14. In this way, a person may use the top surface of upper member 16 as a work surface while being in a position to easily access compartment 68 of lower drawer 14.

Another advantage of the instant invention is the simplicity of construction of work station 10. In accordance with the preferred embodiment, main body portion 12 preferably comprises the exterior of the upper drawer (compartment 52). Thus, side panels 44, front panel 46 and rear panel 48 define not only the upper structural elements of work station 10 but may also comprise the exterior surfaces of main body portion 12 (it will be appreciated that front panel 62 of lower drawer 14 need not extend upwardly to overlie front panel 46). Similarly, side panels 60, front panel 62 and rear panel 64 define not only the lower structural elements of work station 10 but may also comprise the exterior surfaces of the lower portion of work station 10. Thus the construction of work station 10 is simplified since it is not necessary to provide exterior casing panels to provide a decorative finish to the work station and to cover the slides and the like. For example, slide 78 is provided on the inside of the side panel of compartment 52 that removing the slide from view when lower drawer 14 is closed.

It will be appreciated that there various changes and modifications of work station 10 may be made and each is within the scope of this invention. For example, while work station 10 has a rectangular footprint as shown in the Figures, it may be of any particular shape and configuration. Further, for aesthetic reasons, various changes may be made from the size of various panels (such as front panel 62, rear panel 42 as well as side panels 44 or the placement of the legs or the way the legs are incorporated into work station 10. Further, the slides need not be positioned adjacent the top of the drawers but elsewhere such as along the sides of the panels defining the respective drawer or optionally on the bottom panel.

I claim:

1. An article comprising:

(a) a main body portion defining a foot print for the article;

(b) a lower drawer having a front end, a rear end and an upper perimeter defining an open top, at least one slide whereby the lower drawer is slidably mounted with respect to the main body portion along a first line of travel between a closed position and an open position, the at least one slide having a first portion connected to the main body portion and a second portion connected to the lower drawer whereby the slide supports the upper perimeter in a horizontal plane when the lower drawer is open, the front end of the lower drawer having at least one wheel associated therewith; and, (c) an upper member slidably mounted with respect to the main body portion between an open position in which at least a portion of the upper member is horizontally displaced from the main body portion and a closed position in which the upper member is positioned within the foot print.

2. The article as claimed in claim 1 wherein the main body portion has a front end and a rear end, the front end of the main body portion having an opening to receive the lower drawer and the rear end of the main body portion having wheels associated therewith.

3. The article as claimed in claim 1 wherein the main body portion further comprises a compartment positioned beneath the upper member when the upper member is in the closed position, whereby the compartment defines an upper drawer which is open when the upper member is in the open position.

4. The article as claimed in claim 1 wherein the upper member has an upper surface which is flat to provide a work surface.

5. The article as claimed in claim 1 wherein the upper member slides at an angle to the first line of travel.

6. The article as claimed in claim 5 wherein the angle is 90°.

7. An article comprising:

(a) a main body portion having a front end, a rear end and opposing first and second side panels;

(b) a lower drawer having a front end, a rear end and opposing first and second side panels, the lower drawer is slidably mounted with respect to the main body portion along a first line travel between a closed position in which the lower drawer is received in the main body portion and an open position, the front end of the lower drawer having at least one wheel associated therewith, the first and second side panels of the main body portion terminate above the first and second opposing side panels of the lower drawer whereby the first and second side panels of the lower drawer are exterior surfaces of the article when the lower drawer is in the closed position; and, (c) a member extendable outwardly with respect to the main body portion to an open position in which the member provides a generally horizontally disposed work surface which is displaced outwardly from the main body portion, the member moving outwardly in a second line of travel different to the first line of travel whereby the member has an open area there below when in the open position.

8. The article as claimed in claim 7 wherein the front end of the main body portion has an opening to receive the lower drawer and the rear end of the main body portion having wheels associated therewith.

9. The article as claimed in claim 8 wherein the lower drawer has an upper perimeter defining open top and the article further comprises at least one slide having a first portion connected to the main body portion and a second portion connected to the lower drawer whereby the slide supports the upper perimeter in a horizontal plane when the lower drawer is open.

10. The article as claimed in claim 7 wherein the main body portion further comprises a compartment positioned within the main body portion, whereby the compartment defines an upper storage area which is open when the member in the open position.

11. The article as claimed in claim 7 wherein the second line of travel is at an angle of 90° to the first line of travel.

12. An article comprising:

(a) support means for receiving a lower drawer, the support means having a front and a rear, the rear having wheel means associated herewith; and, (b) a lower drawer receivable in the support means and having a front portion, a rear portion, and opposing side panels which define a portion of the exterior surface of the support means, the front portion having wheel means for supporting the front portion of the lower drawer as the lower drawer moves outwardly from the support means in a first line of travel, the rear portion operatively connected to the support means for supporting the rear portion of the lower drawer as the lower drawer moves outwardly from the support means;

(c) an upper member having a flat surface moveable outwardly from the support means to provide a work surface having an open area there below; and, (d) a compartment positioned within the support means, whereby the compartment defines an upper storage area which is open when the upper member is moved outwardly from the support means.

13. The article as claimed in claim 12 wherein the upper member is slidably mounted on the support means.

14. The article as claimed in claim 13 wherein the compartment is positioned beneath the upper member when the upper member is in a closed position.

15. The article as claimed in claim 13 wherein the upper member slides at an angle to the first line of travel.

16. The article as claimed in claim 15 wherein the angle is 90°.

17. The article as claimed in claim 12 wherein the member moves outwardly at an angle of 90° to the to the first line of travel.

18. A computer work station for use by a person while seated, the computer work station comprising:

(a) an upper compartment having side, front and rear panels;

(b) a lower drawer having side, front and rear panels;

(c) an exterior body defined by a plurality of the panels of the upper and lower drawers, the lower drawer movably mounted with respect to the upper drawer in a first line of travel and accessible from above when opened;

(d) an upper member extendable outwardly from the exterior body in a second line of travel at an angle to the first line of travel such that at least a portion of the legs of the person are receivable underneath the upper member when the person is seated at the work station, the upper member defining a flat work surface for adapted for receiving a computer;

(e) a plurality of legs provided adjacent the front panel of the lower drawer;

(f) a plurality of legs provided adjacent the rear panel of the upper drawer; and, (g) at least one wheel associated with a forward portion of the lower drawer.

19. The computer work station as claimed in claim 18 further comprising at least one slide having a first portion connected to the upper drawer and a second portion connected to the lower drawer whereby the slide in combination with the at least one wheel supports the lower drawer when the lower drawer is open.

20. The work station as claimed in claimed 18 wherein the front panel and the rear panel of the lower drawer each have two legs associated therewith and a wheel is provided on with each of the legs associated with the front panel.

21. The computer work station as claimed in claim 19 wherein the member is positioned above the upper drawer and defines an openable lid for the upper drawer.

22. The computer work station as claimed in claim 21 wherein the member is slidable mounted above the upper drawer and slides outwardly along the second line of travel.

23. The computer work station as claimed in claim 22 wherein the angle is 90°.

24. An article comprising:

(a) support means for receiving a lower drawer, the support means having a front and a rear, the rear having wheel means associated herewith; and, (b) a lower drawer receivable in the support means and having a front portion, a rear portion, and opposing side panels which define a portion of the exterior surface of the support means, the front portion having wheel means for supporting the front portion of the lower drawer as the lower drawer moves outwardly from the support means in a first line of travel, the rear portion operatively connected to the support means for supporting the rear portion of the lower drawer as the lower drawer moves outwardly from the support means; and, (c) an upper member having a flat surface moveable outwardly from the support means at an angle of 90° to the first line travel to provide a work surface having an open area there below.

25. The article as claimed in claim 24 wherein the support means further comprises a compartment positioned within the support means, whereby the compartment defines an upper storage area which is open when the upper member is moved outwardly from the support means.

26. The article as claimed in claim 25 wherein the upper member is slidably mounted on the support means.

27. The article as claimed in claim 26 wherein the compartment is positioned beneath the upper member when the upper member is in the closed position.

* * * * *